US007576716B2

(12) United States Patent
Kim et al.

(10) Patent No.: US 7,576,716 B2
(45) Date of Patent: Aug. 18, 2009

(54) DRIVING A DISPLAY PANEL

(75) Inventors: Myoung-Kwan Kim, Seoul (KR); Tae-Kyoung Kang, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 611 days.

(21) Appl. No.: 10/972,187

(22) Filed: Oct. 25, 2004

(65) Prior Publication Data

US 2005/0110706 A1 May 26, 2005

(30) Foreign Application Priority Data

Nov. 22, 2003 (KR) ..... 10-2003-0083371

(51) Int. Cl.
*G09G 3/28* (2006.01)

(52) U.S. Cl. ..... 345/67; 345/68; 345/60; 315/169.4

(58) Field of Classification Search ..... 345/60–68; 315/169.2, 169.4
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,874,932 | A * | 2/1999 | Nagaoka et al. | 345/60 |
| 5,952,782 | A | 9/1999 | Nanto | |
| 6,061,040 | A * | 5/2000 | Onodera et al. | 345/67 |
| RE37,444 | E | 11/2001 | Kanazawa | |
| 6,630,916 | B1 | 10/2003 | Shinoda | |
| 6,686,698 | B2 * | 2/2004 | Takeuchi et al. | 315/169.2 |
| 6,707,436 | B2 | 3/2004 | Setoguchi et al. | |
| 6,720,939 | B2 | 4/2004 | Watabu | |
| 6,720,940 | B2 * | 4/2004 | Awamoto et al. | 345/60 |

FOREIGN PATENT DOCUMENTS

| | | |
|---|---|---|
| JP | 02-148645 | 6/1990 |
| JP | 10-187093 | 7/1998 |
| JP | 2845183 | 10/1998 |
| JP | 2917279 | 4/1999 |
| JP | 2000-276107 | 10/2000 |
| JP | 2001-043804 | 2/2001 |
| JP | 2001-325888 | 11/2001 |
| JP | 2002-14651 | 1/2002 |
| KR | 2000-0002250 | 1/2002 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.
Japanese Office action corresponding to Japanese Patent Application No. 2004-324963, issued on Sep. 11, 2007.

* cited by examiner

*Primary Examiner*—Kevin M Nguyen
(74) *Attorney, Agent, or Firm*—Robert E. Bushnell, Esq.

(57) ABSTRACT

A method and apparatus and program storage device to drive a display panel having a plurality of address electrode groups includes driving the display panel to transmit digital data at a time difference for each group of address electrodes and varying the respective time difference for each group of address electrodes according to a load factor of each group of address electrodes.

15 Claims, 9 Drawing Sheets

DRIVING A DISPLAY PANEL

CLAIM OF PRIORITY

This application makes reference to, incorporates the same herein, and claims all benefits accruing under 35 U.S.C. §119 from an application for METHOD AND APPARATUS FOR DRIVING DISPLAY PANEL earlier filed in the Korean Intellectual Property Office on 22 Nov. 2003 and there duly assigned Ser No. 2003-83371.

BACKGROUND OF THE INVENTION

1. Field of the Invention

The present invention relates to driving a display panel by applying a sustain pulse to an electrode structure forming a display cell, such as a Plasma Display Panel (PDP).

2. Description of the Related Art

In a three-electrode surface-discharge plasma display panel (PDP), address electrode lines $A_1$, $A_2$, . . . , and $A_m$, dielectric layers, Y-electrode lines $Y_1$, . . . , and $Y_n$, X-electrode lines $X_1$, . . . , and $X_n$, a phosphor layer, partition walls, and an MgO protective layer are disposed between front and rear glass substrates of a surface-discharge PDP The address electrode lines $A_1$, $A_2$, . . . , and $A_m$ are formed on a front side of the rear glass substrate in the form of a predetermined pattern. The entire surface of the lower dielectric layer is coated in the front of the address electrode lines $A_1$, $A_2$, . . . , and $A_m$. The partition walls are formed on a front side of the lower dielectric layer to be parallel to the address electrode lines $A_1$, $A_2$, . . . , and $A_m$. The partition walls partition off a discharge area of each display cell and prevent optical cross-talk between the display cells. The phosphor layer is formed between the partition walls.

The X-electrode lines $X_1$, . . . , and $X_n$ and the Y-electrode lines $Y_1$, . . . , and $Y_n$ are formed on a rear side of the front glass substrate in the form of a predetermined pattern to be orthogonal to the address electrode lines A1, $A_2$, . . . , and $A_m$. A corresponding display cell is formed at cross points of the X-electrode lines $X_1$, . . . , and $X_n$ and the Y-electrode lines $Y_1$, . . . , and $Y_n$. Each of the X-electrode lines $X_1$, . . . , and $X_1$, and each of the Y-electrode lines $Y_1$, . . . , and $Y_n$ are formed in such a manner that transparent electrode lines $X_{na}$ and $Y_{na}$ formed of a transparent conductive material such as Indium Tin Oxide (ITO) and metallic electrode lines $X_{nb}$ and $Y_{nb}$ used in improving conductivity are combined with one another. The front dielectric layer is formed in such a manner that the entire surface of the front dielectric layer is coated at rear sides of the X-electrode lines $X_1$, . . . , and $X_n$ and the Y-electrode lines $Y_1$, . . . , and $Y_n$. The protective layer for protecting the PDP from a strong electric field, for example, an MgO layer, is formed in such a manner that the entire surface of the MgO layer is coated on a rear side of the front dielectric layer. A gas used in forming the plasma is sealed in a discharge space.

In a method of driving such a PDP by which reset, addressing, and display sustain steps are sequentially performed in a unit subfield is generally supplied to the PDP. In a reset step, charge states of all display cells to be driven are uniform. In an addressing step, charge states of display cells to be selected and charge states of display cells that will not be selected are set. In a display sustain step, display discharge is performed in display cells to be selected. In this case, plasma is generated from the gas used in forming plasma of the display cells performing display discharge, the phosphor layer of the display cells is excited by radiating ultraviolet rays from the plasma to generate light.

An apparatus for driving the PDP includes an image processor, a logic controller, an address driver, an X-driver, and a Y-driver. The image processor converts an external analog image signal into a digital signal and generates internal image signals, for example, 8-bit red (R), green (G), and blue (B) image data, a clock signal, and vertical and horizontal synchronous signals. The logic controller generates driving control signals $S_A$, $S_Y$, and $S_X$ in response to the internal image signals generated by the image processor. The address driver generates display data signals by processing the address signal $S_A$ from the driving control signals $S_A$, $S_Y$, and $S_X$ generated by the logic controller and supplies the display data signals to address electrode lines. The X-driver processes the X-driving control signal $S_X$ from the driving control signals $S_A$, $S_Y$, and $S_X$ generated by the logic controller and supplies the X-driving control signal $S_X$ to X-electrode lines. The Y-driver processes the Y-driving control signal $S_Y$ from the driving control signals $S_A$, $S_Y$, and $S_X$ generated by the logic controller and supplies the Y-driving control signal $S_X$ to Y-electrode lines.

An example of a widely-used address-display separation driving method is included in U.S. Pat. No. 5,541,618.

FIG. 3 is a view of a conventional address-display separation driving method to be performed on Y-electrode lines of the PDP 1 of FIG. 1. Referring to FIG. 3, a unit frame can be divided into a predetermined number of subfields, for example, eight subfields SF1, . . . , and SF8, in order to realize time division gray-scale display. In addition, each of the subfields SF1, . . . , and SF8 is divided into a reset period (not shown), address periods A1, . . . , and A8, and discharge-sustain periods S1, . . . , and 8.

In each of the address periods A1, . . . , and A8, display data signals are supplied to the address electrode lines ($A_1$, $A_2$, . . . , and $A_m$ of FIG. 1) and simultaneously, a corresponding scan pulse is sequentially supplied to each of Y-electrode lines $Y_1$, $Y_2$, . . . , and $Y_n$.

In each of the discharge-sustain periods S1, . . . , and S8, display-discharge pulses are alternately supplied to the Y-electrode lines $Y_1$, $Y_2$, . . . , and $Y_n$ and X-electrode lines $X_1$, $X_2$, . . . , and $X_n$ such that display discharge occurs in discharge cells in which wall charges are formed in the address periods A1, . . . , and A8.

The luminance of a PDP is proportional to the number of discharge-sustain pulses in the discharge-sustain periods S1, . . . , and S8 of the unit frame. When one frame used in forming one image is represented as eight subfields and a 256 level gray scale, different number of sustain pulses can be allocated to each subfield at the rates of 1, 2, 4, 8, 16, 32, 64, and 128. In order to realize the luminance of a 133 level gray scale, cells are addressed and discharge sustained for a first subfield period, a third subfield period, and an eighth subfield period.

The number of sustain pulses to be allocated to each subfield can vary according to weighed values of the subfields in an automatic power control (APC) step. In addition, the number of sustain pulses to be allocated to each subfield can be diversely modified in consideration of gamma characteristics or panel characteristics. For example, a gray scale allocated to a fourth subfield can be reduced from 8 to 6, and a gray scale allocated to a sixth subfield can be increased from 32 to 34. In addition, the number of subfields used in forming one frame can be diversely modified according to design specifications.

The driving signals for driving the PDP include signals supplied to an address electrode A, a common electrode X, and scan electrodes $Y_1$, $Y_2$, . . . , and $Y_n$ in one subfield SF using an address display separated driving method for an AC PDP. One subfield SF includes a reset period PR, an address period PA, and a discharge-sustain period PS.

In the reset period PR, reset pulses are supplied to scan lines of all groups and write discharge is forcibly performed such that states of wall charges of all cells are reset. The reset period PR is performed before the address period PA over the entire screen such that wall charges are disposed in the form of uniform and desired distribution. Wall charge conditions are similar to one another in the cells reset by the reset period PR. After the reset period PR has been performed, the address period PA is performed. In this case, in the address period PA, a bias voltage $V_e$ is supplied to the common electrode X and the scan electrodes $Y_1$, $Y_2$, . . . , and $Y_n$ and the address electrodes $A_1$, . . . , and $A_m$ are turned on at the same time in positions of cells to be displayed so that display cells are selected. After the address period PA has been performed, sustain pulses $V_s$ are alternately supplied to the common electrode X and the scan electrodes $Y_1$, $Y_2$, . . . , and $Y_n$ such that the discharge-sustain period PS is performed. Voltages $V_G$ having a low level are supplied to the address electrodes $A_1$, . . . , and $A_m$ during the discharge-sustain period PS.

The luminance of a PDP is adjusted by the number of discharge-sustain pulses. As the number of discharge-sustain pulses in one subfield or one TV field increases, the luminance of the PDP increases.

An object of a display apparatus of Korean Patent Publication No. 2002-0002250 is to solve problems due to noise occurring in a display screen caused by a large volume of electron waves or magnetic fields generated when a plurality of digital signals having the same phase are transited in an address period at the same time or the electron waves or electric fields have an effect on another device or circuit. To this end, the apparatus of the Patent Publication is characterized in that digital data having different phases are transmitted to each of a plurality of address electrode driving circuits.

However, in the above-described Patent Publication, by applying voltages to each group of address electrodes at a predetermined time difference Δt, noise is prevented from occurring due to electron waves etc. However, due to a uniform time difference, a time delay inevitably occurs in each scan operation in one line. As a result, an address period can be lengthened.

SUMMARY OF THE INVENTION

The present invention provides a method and apparatus and program storage device for adaptively driving a display panel to reduce time delay without generating noise due to electron waves etc. in an address period.

According to one aspect of the present invention, a method of driving a display panel having a plurality of address electrode groups is provided, the method comprising driving the display panel to transmit digital data at a time difference for each group of address electrodes and varying the respective time difference for each group of address electrodes according to a load factor of each group of address electrodes.

The time difference preferably has a value greater than 0 and less than a predetermined value upon the load factor of each group of address electrodes being in a range of from 0% to 100%.

Digital data is preferably transmitted at the same time upon a sum of load factors of each group being less than a predetermined value.

According to another aspect of the present invention, a method of driving a display panel having a plurality of address electrode groups is provided, the method comprising driving the display panel to transmit digital data at a time difference for each group of address electrodes and combining groups of address electrodes according to load factors of the groups of address electrodes.

The method preferably further comprises: determining ranking of each group of address electrodes according to a load factor of each group; combining groups of address electrodes with one another so that a sum of a load factor of a group having a high load factor and a load factor of a group having a low load factor is less than a predetermined value; and transmitting digital data of the combined groups at a predetermined time difference.

The time difference preferably varies according to a sum of load factors of the combined groups.

Digital data is preferably transmitted at the same time upon a sum of load factors of each group being less than a predetermined value.

According to yet another aspect of the present invention, an apparatus for driving a display panel is provided, the apparatus comprising: a load factor detector adapted to detect a load factor for each of a plurality of groups of address electrodes; an address data controller adapted to calculate a time difference at which data is to be transmitted for each group of address electrodes according to the detected load factor for each group of address electrodes and to generate a control signal to control data transmission of each group of address electrodes according to the calculated time difference; and a plurality of address drivers adapted to transmit address data to an address electrode of each group in response to the control signal.

According to still another aspect of the present invention, a program storage device, readable by a machine, tangibly embodying a program of instructions executable by the machine to perform a method of driving a display panel having a plurality of address electrode groups is provided, the method comprising driving the display panel to transmit digital data at a time difference for each group of address electrodes and varying the respective time difference for each group of address electrodes according to a load factor of each group of address electrodes.

The time difference preferably has a value greater than 0 and less than a predetermined value upon the load factor of each group of address electrodes being in a range of from 0% to 100%.

Digital data is preferably transmitted at the same time upon a sum of load factors of each group being less than a predetermined value.

According to still yet another aspect of the present invention, a program storage device, readable by a machine, tangibly embodying a program of instructions executable by the machine to perform a method of driving a display panel having a plurality of address electrode groups is provided, the method comprising driving the display panel to transmit digital data at a time difference for each group of address electrodes and combining groups of address electrodes according to load factors of the groups of address electrodes.

The method preferably further comprises: determining ranking of each group of address electrodes according to a load factor of each group; combining groups of address electrodes with one another so that a sum of a load factor of a group having a high load factor and a load factor of a group having a low load factor is less than a predetermined value; and transmitting digital data of the combined groups at a predetermined time difference.

The time difference preferably varies according to a sum of load factors of the combined groups.

Digital data is preferably transmitted at the same time upon a sum of load factors of each group being less than a predetermined value.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
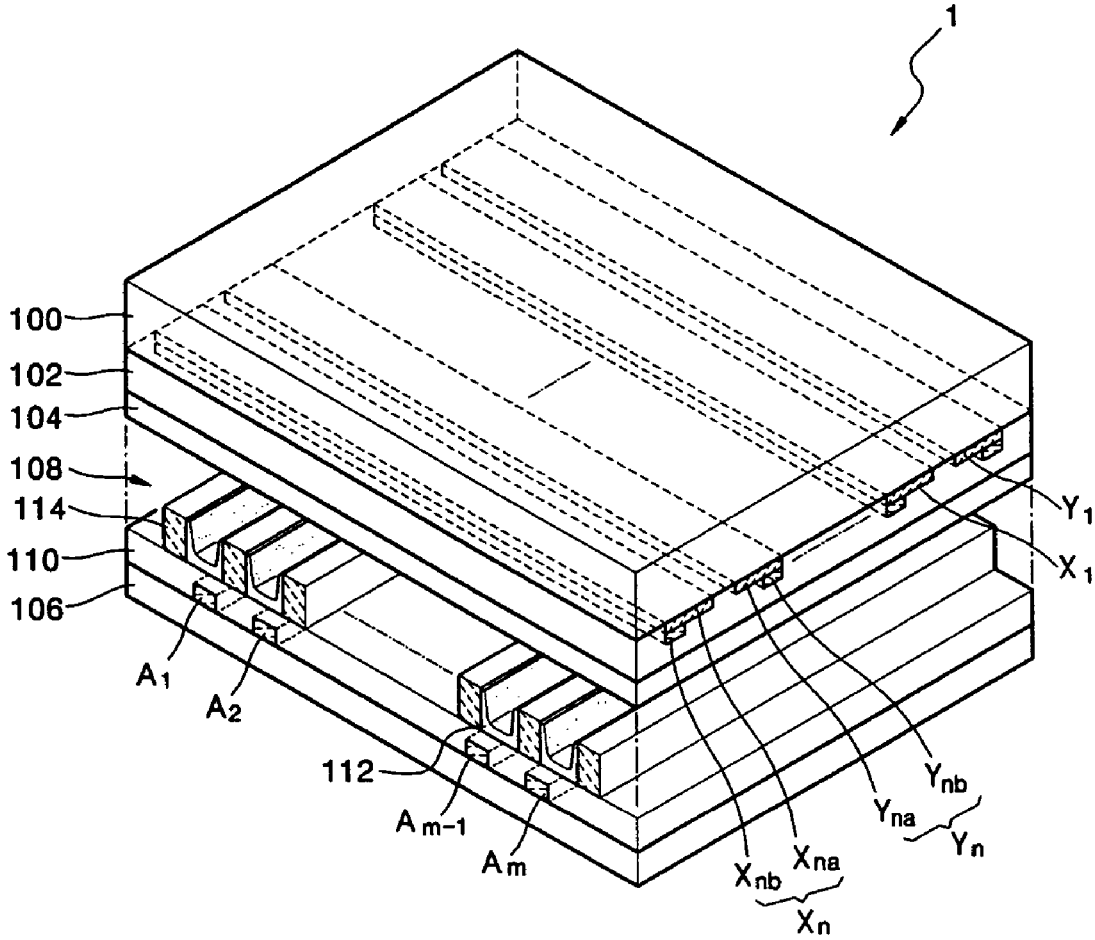
FIG. 1 is a view of the structure of a three-electrode surface-discharge type plasma display panel (PDP)

FIG. 1 is a view of the structure of a three-electrode surface-discharge type plasma display panel (PDP). Referring to FIG. 1, address electrode lines $A_1, A_2, \ldots$, and $A_m$, dielectric layers 102 and 110, Y-electrode lines $Y_1, \ldots$, and $Y_n$, X-electrode lines $X_1, \ldots$, and $X_n$, a phosphor layer 112, partition walls 114, and an MgO protective layer 104 are disposed between front and rear glass substrates 100 and 106 of a surface-discharge plasma display panel (PDP) 1.

The address electrode lines $A_1, A_2, \ldots$, and $A_m$ are formed in a predetermined pattern on a front side of the rear glass substrate 106. The entire surface of the lower dielectric layer 110 is coated in front of the address electrode lines $A_1$, $A_2, \ldots$, and $A_m$. The partition walls 114 are formed on a front side of the lower dielectric layer 110 to be parallel to the address electrode lines $A_1, A_2, \ldots$, and $A_m$. The partition walls 114 partition off a discharge area of each display cell and prevent optical cross-talk between the display cells. The phosphor layer 112 is formed between the partition walls 114.

The X-electrode lines $X_1, \ldots$, and $X_n$ and the Y-electrode lines $Y_1, \ldots$, and $Y_n$ are formed in a predetermined pattern on a rear side of the front glass substrate 100 so as to be orthogonal to the address electrode lines A1, $A_2, \ldots$, and $A_m$. A corresponding display cell is formed at cross points of the X-electrode lines $X_1, \ldots$, and $X_n$ and the Y-electrode lines $Y_1, \ldots$, and $Y_n$. Each of the X-electrode lines $X_1, \ldots$, and $X_n$ and each of the Y-electrode lines $Y_1, \ldots$, and $Y_n$ are formed in such a manner that transparent electrode lines $X_{na}$ and $Y_{na}$ formed of a transparent conductive material such as Indium Tin Oxide (ITO) and metallic electrode lines $X_{nb}$ and $Y_{nb}$ used in improving conductivity are combined with one another. The front dielectric layer 102 is formed such that the entire surface of the front dielectric layer 102 is coated on rear surfaces of the X-electrode lines $X_1, \ldots$, and $X_n$ and the Y-electrode lines $Y_1, \ldots$, and $Y_n$. The protective layer 104 for protecting the PDP 1 from a strong electric field, for example, an MgO layer, is formed such that the entire surface of the MgO layer 104 is coated on a rear side of the front dielectric layer 102. A gas used in forming a plasma is sealed in a discharge space 108.

In a method of driving the PDP, reset, addressing, and display sustain steps are sequentially performed in a unit subfield. In a reset step, the charge states of all of the display cells to be driven are uniform. In an addressing step, the charge states of the display cells to be selected and the charge states of the display cells that will not be selected are set. In a display sustain step, a display discharge is performed in display cells to be selected. A plasma is generated by the gas used in forming the plasma of the display cells performing a display discharge, the phosphor layer 112 of the display cells being excited by ultraviolet rays radiated from the plasma to generate light.

Figure 2:
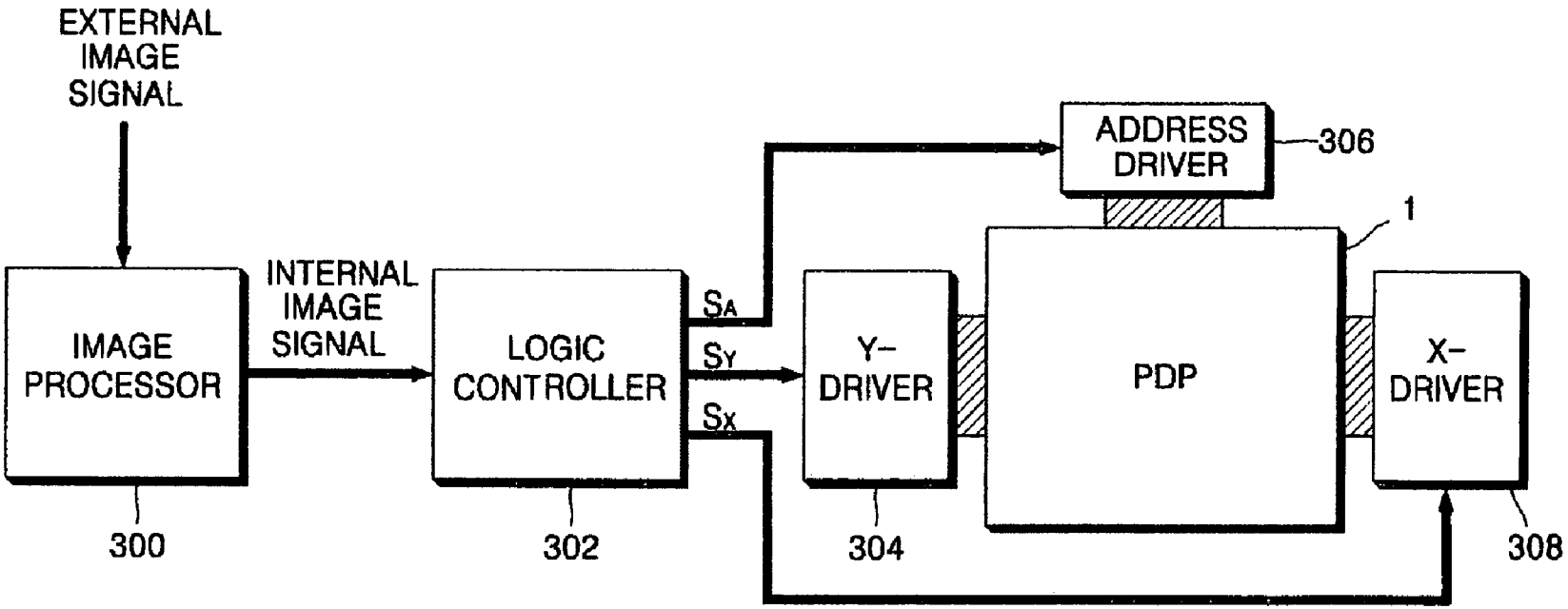
FIG. 2 is a view of the structure of a apparatus for driving the PDP of FIG. 1.

FIG. 2 is a view of the structure of an apparatus for driving the PDP 1 of FIG. 1. Referring to FIG. 2, the apparatus for driving the PDP 1 of FIG. 1 includes an image processor 200, a logic controller 202, an address driver 206, an X-driver 208, and a Y-driver 204. The image processor 200 converts an external analog image signal into a digital signal and generates internal image signals, for example, 8-bit red (R), green (G), and blue (B) image data, a clock signal, and vertical and horizontal synchronous signals. The logic controller 202 generates driving control signals $S_A$, $S_Y$, and $S_X$ in response to the internal image signals generated by the image processor 200. The address driver 206 generates display data signals by processing the address signal $S_A$ from the driving control signals $S_A$, $S_Y$, and $S_X$ generated by the logic controller 202 and supplies the display data signals to address electrode lines. The X-driver 208 processes the X-driving control signal $S_X$ from the driving control signals $S_A$, $S_Y$, and $S_X$ generated by the logic controller 202 and supplies the X-driving control signal $S_X$ to X-electrode lines. The Y-driver 204 processes the Y-driving control signal $S_Y$ from the driving control signals $S_A$, $S_Y$, and $S_X$ generated by the logic controller 202 and supplies the Y-driving control signal $S_Y$ to Y-electrode lines.

Figure 3:
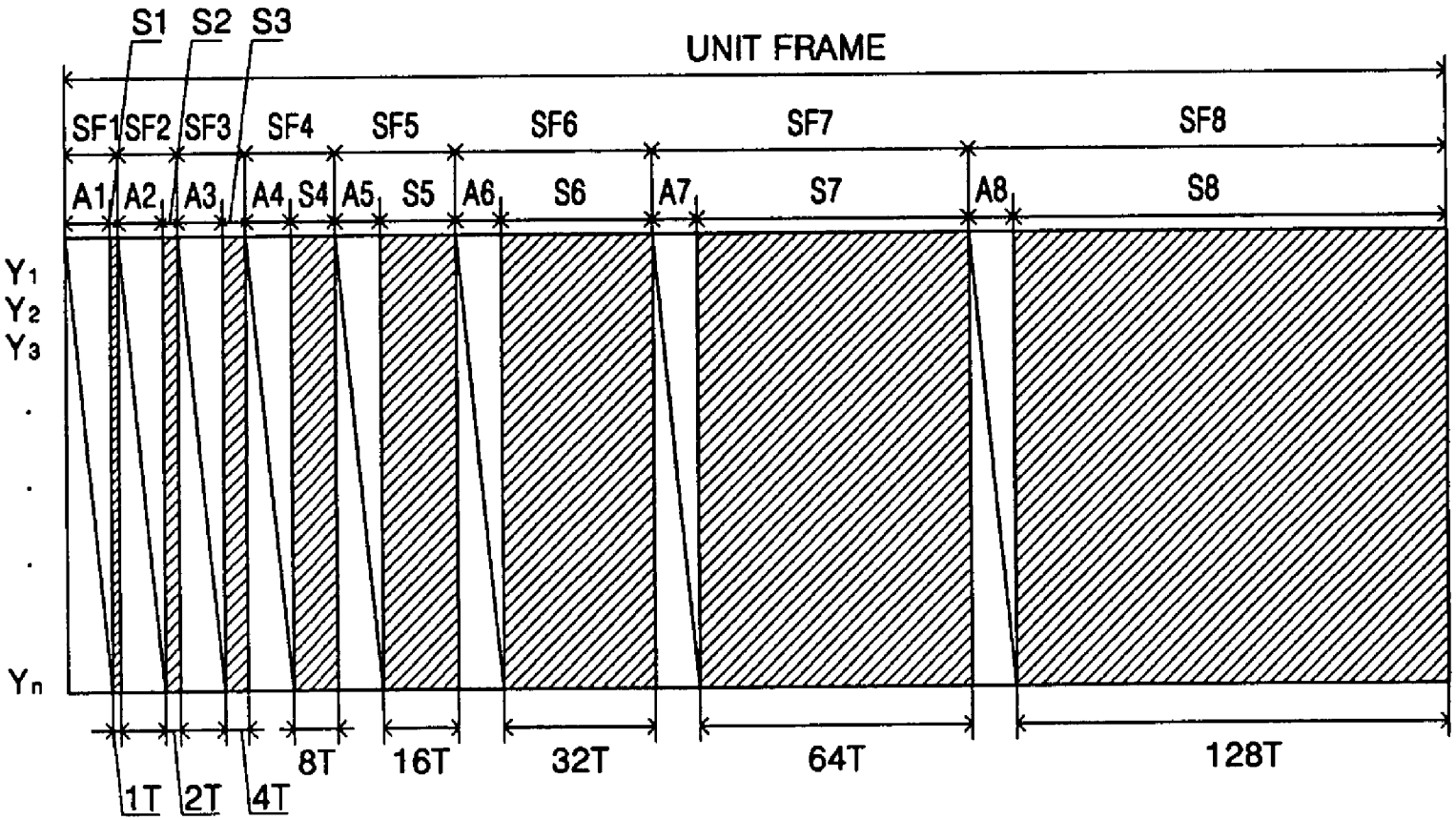
FIG. 3 is a view of a address-display separation driving method to be performed on Y-electrode lines of the PDP of FIG. 1.

FIG. 3 is a view of a address-display separation driving method to be performed on Y-electrode lines of the PDP 1 of FIG. 1. Referring to FIG. 3, a unit frame can be divided into a predetermined number of subfields, for example, eight subfields SF1, . . . , and SF8, in order to realize time division gray-scale display. In addition, each of the subfields SF1, . . . , and SF8 is divided into a reset period (not shown), address periods A1, . . . , and A8, and discharge-sustain periods S1, . . . , and S8.

In each of the address periods A1, . . . , and A8, display data signals are supplied to the address electrode lines ($A_1, A_2, \ldots$, and $A_m$ of FIG. 1) and simultaneously, a corresponding scan pulse is sequentially supplied to each of Y-electrode lines $Y_1$, $Y_2$, . . . , and $Y_n$.

In each of the discharge-sustain periods S1, . . . , and S8, display-discharge pulses are alternately supplied to the Y-electrode lines $Y_1$, $Y_2$, . . . , and $Y_n$ and X-electrode lines $X_1$, $X_2$, . . . , and $X_n$ such that display discharge occurs in discharge cells in which wall charges are formed in the address periods A1, . . . , and A8.

The luminance of a PDP is proportional to the number of discharge-sustain pulses in the discharge-sustain periods S1, . . . , and S8 of the unit frame. When one frame used in forming one image is represented by eight subfields and a 256 level gray scale, a different number of sustain pulses can be allocated to each subfield at the rates of 1, 2, 4, 8, 16, 32, 64, and 128 pulses per subfield. In order to realize the luminance of a 133 level gray scale, cells are addressed and a discharge sustained for a first subfield period, a third subfield period, and an eighth subfield period.

The number of sustain pulses to be allocated to each subfield can vary according to weighed values of the subfields in an Automatic Power Control (APC) step. In addition, the number of sustain pulses to be allocated to each subfield can be diversely modified in consideration of gamma characteristics or panel characteristics. For example, a gray scale allocated to a fourth subfield can be reduced from 8 to 6, and a gray scale allocated to a sixth subfield can be increased from 32 to 34. In addition, the number of subfields used in forming one frame can be diversely modified according to design specifications.

Figure 4:
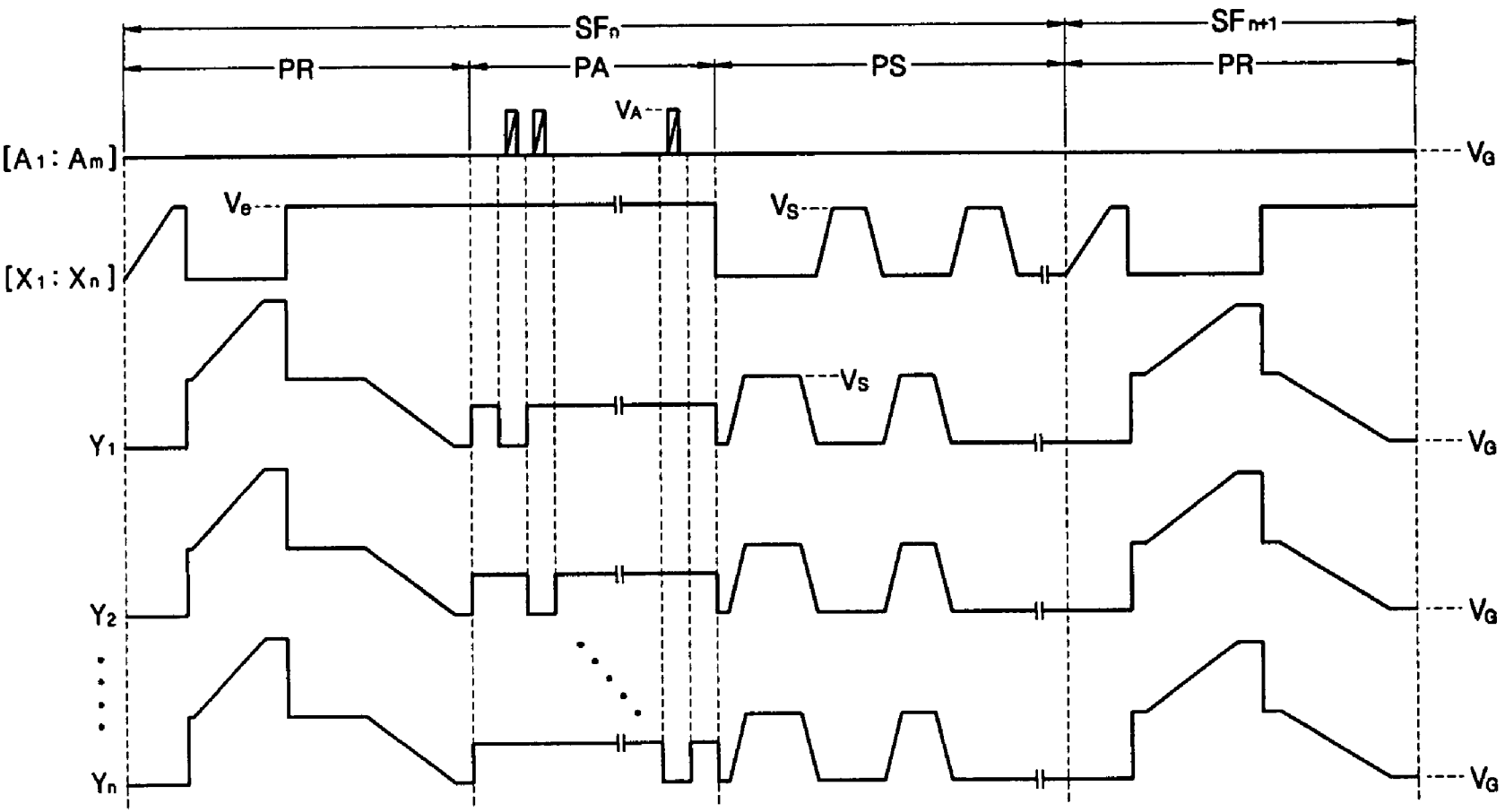
FIG. 4 is a timing diagram for an example of driving signals of the PDP of FIG. 1.
Figure 5:
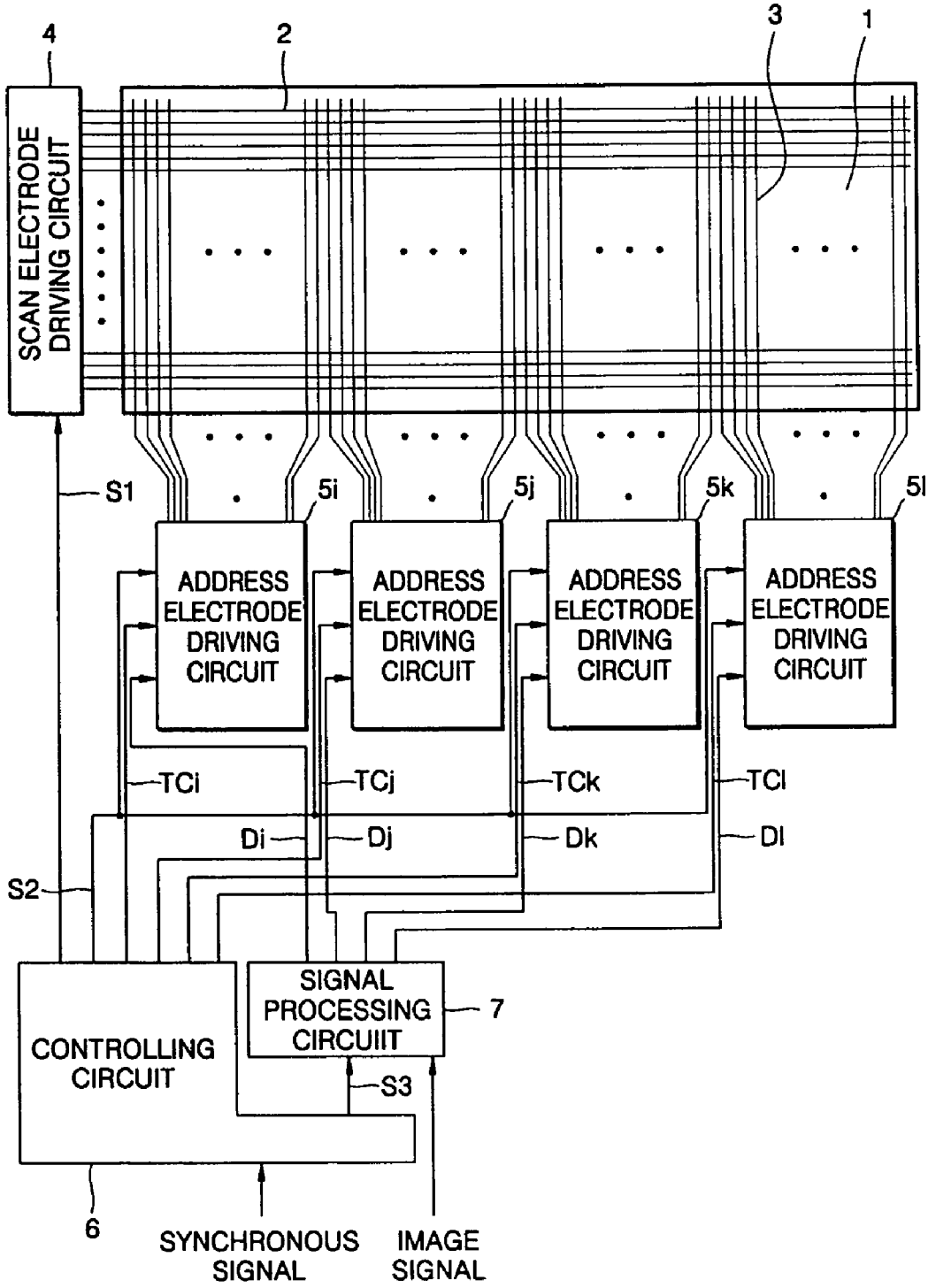
FIG. 5 (PRIOR ART)
FIG. 5 is a block diagram of the structure of a display apparatus of Korean Patent Publication No. 2002-0002250.

FIG. 4 is a timing diagram of an example of driving signals of the PDP 1 of FIG. 1. The driving signals of FIG. 4 represent driving signals supplied to an address electrode A, a common electrode X, and scan electrodes $Y_1$, $Y_2$, . . . , and $Y_n$ in one subfield SF using an address display separated driving method for an AC PDP. Referring to FIG. 4, one subfield SF includes a reset period PR, an address period PA, and a discharge-sustain period PS.

In the reset period PR, reset pulses are supplied to scan lines of all groups and a write discharge is forcibly performed such that the states of the wall charges of all of the cells are reset. The reset period PR occurs before the address period PA over the entire screen such that the wall charges are disposed in a uniform desired distribution. The wall charge conditions are similar to one another in the cells reset by the reset period PR. The address period PA occurs after the reset period PR. During the address period PA, a bias voltage $V_e$ is supplied to the common electrode X and the scan electrodes $Y_1$, $Y_2$, . . . , and $Y_n$ and the address electrodes $A_1$, . . . , and $A_m$ are turned on at the same time in the positions of cells to be displayed so that the display cells are selected. After the address period PA has occurred, the discharge-sustain period PS occurs such that sustain pulses VS are alternately supplied to the common electrode X and the scan electrodes $Y_1$, $Y_2$, . . . , and $Y_n$. Voltages $V_G$ having a low level are supplied to the address electrodes $A_1$, . . . , and $A_m$ during the discharge-sustain period PS.

The luminance of a PDP is adjusted by the controlling the number of discharge-sustain pulses. As the number of discharge-sustain pulses in one subfield or one TV field increases, the luminance of the PDP increases.

Figure 6:
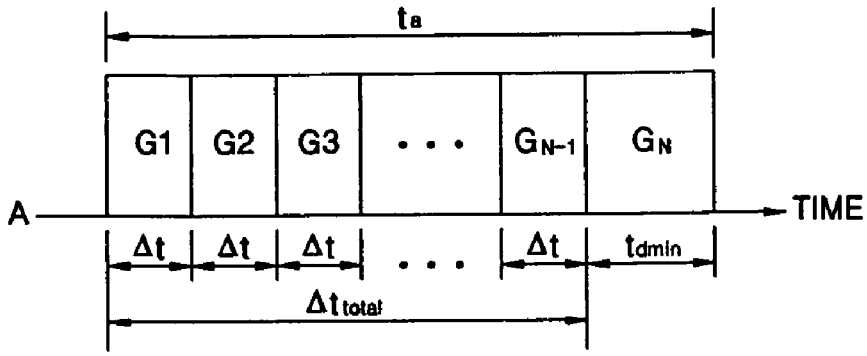
FIG. 6 is a timing diagram for address data transmitted at a predetermined time difference Δt in each group of address electrodes.

FIG. 6 is a timing diagram of address data transmitted at a predetermined time difference Δt in each group of address electrodes. A minimum time tdmin taken for discharge is a minimum scan time taken for address discharge without errors in consideration of a discharge delay time etc. . Thus, in FIG. 6, the time taken for addressing in one line is determined by $\Delta t_{total}$ which is the sum of (n−1) time differences Δt, and by the minimum time tdmin taken for discharge. Each group transmits data at a time difference Δt but the minimum time tdmin taken for discharge is allocated to each group.

Figure 7:
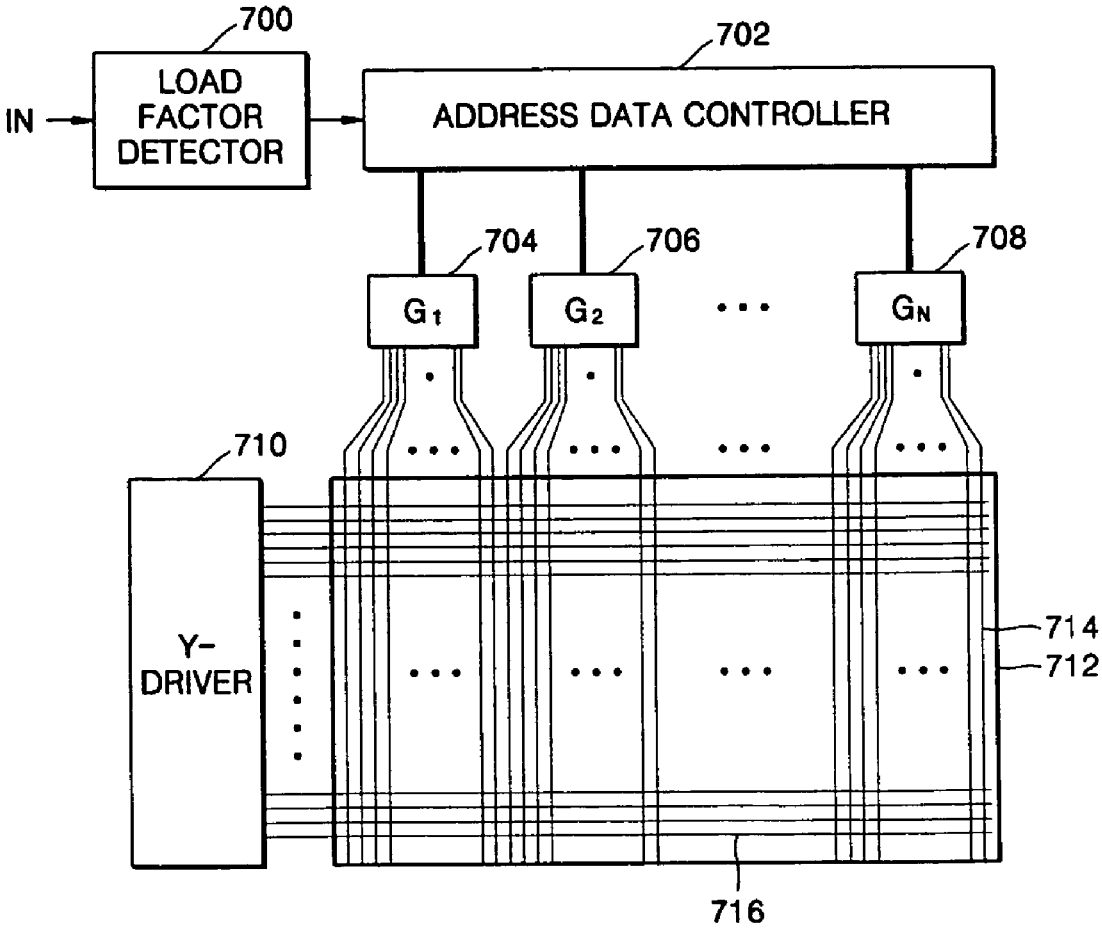
FIG. 7 is a block diagram of an apparatus for driving a display panel according to an embodiment of the present invention.

FIG. 7 is a block diagram of an apparatus for driving a display panel according to an embodiment of the present invention. The apparatus of FIG. 7 includes a load factor detector 700, an address data controller 702, a plurality of address drivers $G_1$ (704), $G_2$ (706), . . . , and $G_N$ (708), and a Y-driver 710.

The load factor detector 700 detects a load factor in each scan line using externally supplied address data IN. The load factor has a value ranging from zero when the percentage corresponds to 0% and to 100 when the percentage corresponds to 100% in each group of address electrodes. For example, the load factor can be determined by counting the number of cells turned on in each group of address electrodes and by dividing a counting result by the number of address electrodes in each group.

The address data controller 702 determines a time difference at which data is to be transmitted in each group of address electrodes according to a load factor detection result in each group of address electrodes. If the time difference is determined according to each group of address electrodes, a time difference is set for each group of address electrodes, and a control signal having a width of the minimum time $t_{dmin}$ taken for discharge is generated. In this case, the time difference according to load factors can range from a predetermined minimum value to a predetermined maximum value. In particular, if the load factor of a current group is zero when the percentage corresponds to 0%, the time difference can be determined to be zero, and if the load factor of the current group is 100when the percentage corresponds to 100%, the time difference can be determined to be a predetermined maximum value.

The plurality of address drivers 704, 706, and 708 transmits address data to each group of address electrodes in response to the control signal. Each driver includes a shift register etc. and transmits input address data to an address electrode at a predetermined time in response to the control signal.

The Y-driver 710 supplies a scan pulse having a predetermined time and a predetermined pulse width to a Y-electrode 716.

Hereinafter, a method of driving a display panel according to an embodiment of the present invention will be described in detail.

The method of driving the display panel relates to a method of driving an address of a display panel having a plurality of address electrode groups.

The method of driving the display panel is characterized in that digital data is transmitted at a predetermined time difference in each group of address electrodes and the time difference varies according to a load factor of each group of address electrodes.

The load factor has a value ranging from zero when the percentage corresponds to 0% and to 100when the percentage corresponds to 100% in each group of address electrodes. For example, the load factor can be determined by counting the number of cells turned on in each group of address electrodes and dividing a counting result by the number of address electrodes in each group. The time difference according to the load factor can range from a predetermined minimum value to a predetermined maximum value. In particular, if the load factor of a current group is zero when the percentage corresponds to 0%, data can be transmitted without a time difference after data of a previous group has been transmitted, and if the load factor of the current group is 100 when the percentage corresponds to 100%, data can be transmitted at a predetermined maximum time difference.

Figure 8:
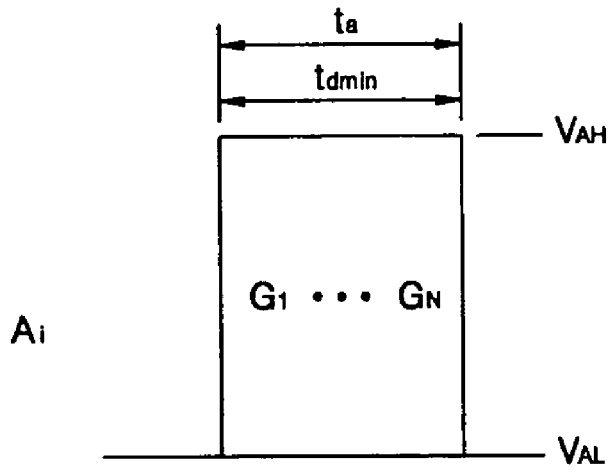
FIG. 8 is a timing diagram for explaining an address period when a load factor of all address groups in one line is zero.

FIG. 8 is a timing diagram for explaining an address period when a load factor of all address groups in one line is zero. In FIG. 8, if address data in a current line is zero, a time difference at which data is transmitted in each group of address electrodes is zero. Thus, a current address time ta is equal to a minimum time tdmin taken for discharge.

In the modification of FIG. 8, if the load factor is less than a predetermined value, data can also be transmitted at a time difference 0. In addition, if the sum of load factors of each group is less than a predetermined value, all groups can also transmit data at the same time. The value of a load factor at which data can be transmitted at a time difference 0 can be properly determined in consideration of structural and electrical characteristics of a display panel according to design specifications of the display panel.

Figure 9:
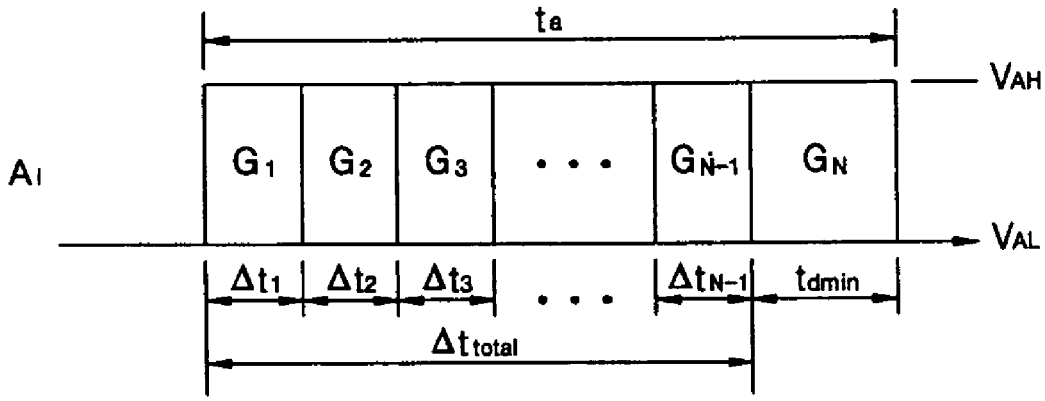
FIG. 9 is a timing diagram for explaining an address period when address data are transmitted by varying a time difference according to a load factor of each address group.

FIG. 9 is a timing diagram for explaining an address period when address data is transmitted by varying a time difference according to a load factor of each address group. Groups having the same load factor transmit data at the same time difference, and data can be transmitted by varying a time difference according to a load factor of each address group. In FIG. 9, time differences $\Delta t1$ through $\Delta t_{N-1}$ of each group can have different values to be proportional to a load factor of each group.

To explain FIG. 9, Table 1 is a view of ranked load factors according to address groups in one line.

TABLE 1

| Ranking | Group No. | Load factor according to group |
|---|---|---|
| 1 | $G_3$ | 85% |
| 2 | $G_1$ | 70% |
| 3 | $G_{N-1}$ | 60% |
| . | . | . |
| . | . | . |
| . | . | . |
| N-3 | $G_7$ | 15% |
| N-2 | $G_6$ | 13% |
| N-1 | $G_N$ | 10% |
| N | $G_2$ | 0% |

In Table 1, the largest load factor of a group is 85% for group 3 ($G_3$), and the smallest IS load factor of a group is 0% for group 2 ($G_2$).

Explaining FIG. 9 with reference to the load factors shown in Table 1, if a time difference of a group having a load factor 100% is $\Delta t$, a time difference $\Delta t_3$ of the group 3 ($G_3$) is 0.85 $\Delta t$, a time difference $\Delta t_1$ of a group 1 ($G_6$) is 0.7 $\Delta t$, and a time difference $\Delta t_N$-1 of a group N-1 ($G_{N-1}$) is 0.6 $\Delta t$.

The method of driving the display panel can be implemented so that address groups are combined with one another according to load factors, so as to transmit data at the same time. In Table 1, address groups are combined with one another so that the sum of load factors of a group having a low load factor and a group having a high load factor is less than a predetermined value, so as to transmit data at the same time. For example, assuming that a load factor at which data can be transmitted at the same time is determined to be 90%, the sum of a load factor of the group 3 ($G_3$) having first ranking and a load factor of a group 2 ($G_2$) having N ranking is 85%, and thus, the group 3 ($G_3$) and the group 2 ($G_2$) can be combined with each other to transmit data at the same time. In addition, since the sum of a load factor of the group 1 ($G_1$) having second ranking and a load factor of a group N ($G_N$) having N ranking is 80%, the group 1 ($G_1$) and the group N ($G_N$) can be combined with each other to transmit data at the same time. Similarly, groups $G_{N-1}$, $G_7$, and $G_6$ having the sum of load factors 83% can be combined with one another to transmit data at the same time.

Figure 10:
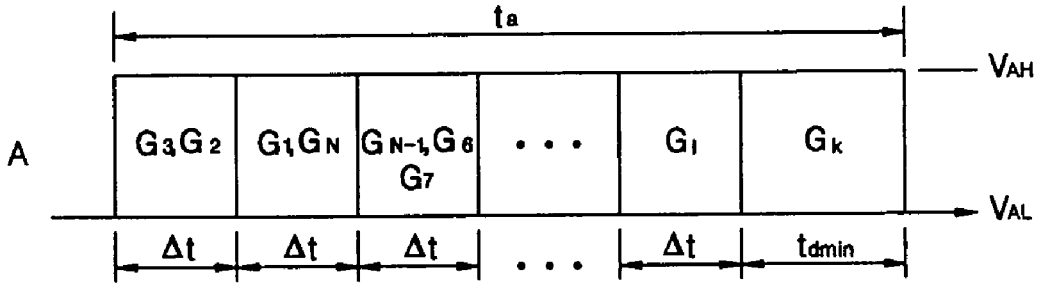
FIG. 10 is a timing diagram for explaining an example of an address period when address data are transmitted at the same time with combinations of address groups according to load factors of the address groups.

FIG. 10 is a timing diagram for explaining an example of an address period when address data is transmitted at the same time with combinations of address groups according to load factors of the address groups. FIG. 10 is a view of an example in which a time difference between combined groups for transmitting data at the same time is constant, $\Delta t$.

Figure 11:
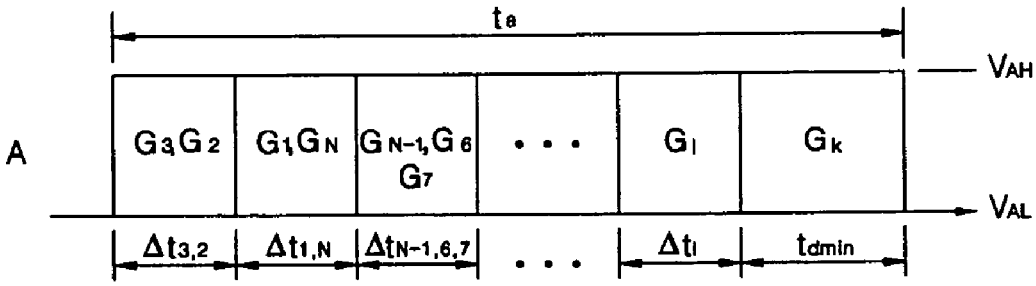
FIG. 11 is a timing diagram for explaining another example of an address period when address data are transmitted at the same time with combinations of address groups according to load factors of the address groups.

FIG. 11 is a timing diagram for explaining another example of an address period when address data is transmitted at the same time with combinations of address groups according to load factors of the address groups. FIG. 11 is a view of an example in which a time difference between combined groups for transmitting data at the same time varies according to combined load factors.

In Table 1, if a time difference which corresponds to a load factor 100% is $\Delta t$, the sum of load factors of the groups $G_3$ and $G_2$ is 85%, and thus, a time difference $At_{3,2}$ can be 0.85 $\Delta t$. In addition, since the sum of load factors of the groups $G_1$ and $G_N$ is 80%, a time difference $\Delta t_1$, N can be 0.8 $\Delta t$. In addition, since the sum of load factors of the groups $G_{N-1}$, $G_6$, and $G_7$ is 88%, a time difference $\Delta t_{N-1,\ 6,\ 7}$ can be 0.88 $\Delta t$.

Figure 12:
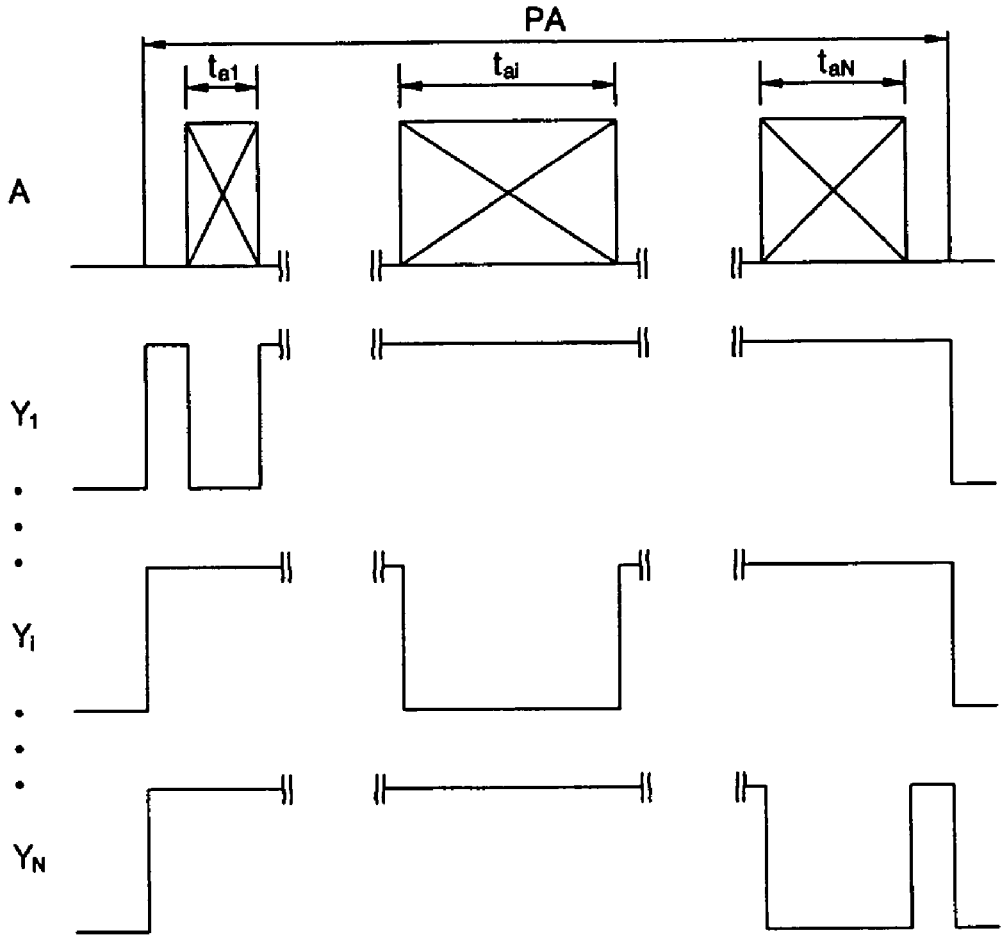
FIG. 12 is a timing diagram for explaining an embodiment of an address period using the method of driving the display panel according to the present invention.

FIG. 12 is a timing diagram for explaining an embodiment of an address period using the method of driving the display panel according to the present invention. Referring to FIG. 12, a scan pulse width $t_{al}$ of a first scan line $Y_1$, a scan pulse width $t_{ai}$ of an i-th scan line $Y_i$, and a scan pulse width $t_{aN}$ of an N-th scan line $Y_N$ are different. In the present embodiment, the reason why scan pulse widths are different according to scan lines is that data is transmitted at different time differences according to address groups.

The present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, hard disks, floppy disks, flash memories, and optical data storage devices. Programs to be stored in a recording medium are programs represented as a series of instruction commands directly or indirectly used in an apparatus having an information processing capability such as a computer, so as to obtain a specific result. Thus, although a term 'computer' has been actually used, the term 'computer' should be construed as meaning all apparatus having information processing capabilities for performing a specific function using programs by providing memories, input/output units, and operating units. Even in the case of an apparatus for driving a display panel, the purpose of the apparatus is limited to a specific field of display panel driving, and the apparatus can be considered to be a special purpose computer.

In particular, the method of driving the display panel according to the present invention can be implemented using an integrated circuit, which is written by schematic or Very high speed integrated circuit Hardware Description Language (VHDL) on a computer, is connected to the computer and is programmable, for example, Field Programmable Gate Array (FPGA). The recording medium includes such a programmable integrated circuit.

As described above, in the method and apparatus for driving a display panel according to the present invention, digital data can be transmitted at a predetermined time difference according to each group of address electrodes so that noise is not generated due to electron waves in an address period, and the time delay in the address period can be adaptively reduced according to a load factor of each group of address electrodes.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A method of driving a display panel having a plurality of individually driven address electrode groups, the method comprising:

detecting a load factor of each group of address electrodes;

driving the display panel to transmit digital data at a time difference for each group of address electrodes, and varying the respective time difference for each group of address electrodes according to the detected load factor of each group of address electrodes;

wherein the respective time difference of each group of address electrodes increases when the respective load factor of each group of address electrodes increases.

2. The method of claim 1, wherein the time difference has a value greater than 0 and less than a predetermined value upon the load factor of each group of address electrodes being in a range of from 0% to 100%.

3. The method of claim 1, wherein digital data is transmitted at the same time upon a sum of load factors of each group being less than a predetermined value.

4. A method of driving a display panel having a plurality of individually driven address electrode groups, the method comprising:

driving the display panel to transmit digital data at a time difference for each group of address electrodes, combining groups of address electrodes according to load factors of the groups of address electrodes, and varying the respective time difference for each combined group of address electrodes according to a sum of the load factors of combined groups of address electrodes, wherein the respective time difference of each group of address electrodes increases when the sum of load factors of the groups of address electrodes increases.

5. The method of claim 4, further comprising:

determining ranking of each group of address electrodes according to a load factor of each group;

combining groups of address electrodes with one another so that a sum of a load factor of a group having a high load factor and a load factor of a group having a low load factor is less than a predetermined value; and transmitting digital data of the combined groups at a predetermined time difference.

6. The method of claim 5, wherein the time difference varies according to a sum of load factors of the combined groups.

7. The method of claim 4, wherein digital data is transmitted at the same time upon a sum of load factors of each group being less than a predetermined value.

8. An apparatus for driving a display panel having a plurality of address electrode groups, comprising:

a load factor detector adapted to detect a load factor for each of a plurality of groups of address electrodes;

an address data controller adapted to calculate a time difference at which data is to be transmitted for each group of address electrodes according to the detected load factor for each group of address electrodes and to generate a control signal to control data transmission of each group of address electrodes according to the calculated time difference; and a plurality of address drivers adapted to transmit address data to an address electrode of each group in response to the control signal;

wherein the respective time difference of each group of address electrodes increases when the load factor of each group of address electrodes increases.

9. A program storage device, readable by a machine, tangibly embodying a program of instructions executable by the machine to perform a method of driving a display panel having a plurality of address electrode groups, the method comprising:

detecting a load factor of each group of address electrodes;

driving the display panel to transmit digital data at a time difference for each group of address electrodes, and varying the respective time difference for each group of address electrodes according to the detected load factor of each group of address electrodes;

wherein the respective time difference of each group of address electrodes increases when the respective load factor of each group of address electrodes increases.

10. The program storage device of claim 9, wherein the time difference has a value greater than 0 and less than a predetermined value upon the load factor of each group of address electrodes being in a range of from 0% to 100%.

11. The program storage device of claim 9, wherein digital data is transmitted at the same time upon a sum of load factors of each group being less than a predetermined value.

12. A program storage device, readable by a machine, tangibly embodying a program of instructions executable by the machine to perform a method of driving a display panel having a plurality of address electrode groups, the method comprising:

driving the display panel to transmit digital data at a time difference for each group of address electrodes, combining groups of address electrodes according to load factors of the groups of address electrodes, and varying the respective time difference for each combined group of address electrodes according to a sum of the load factors of combined groups of address electrodes, wherein the respective time difference of each group of address electrodes increases when the sum of load factors of the groups of address electrodes increases.

13. The program storage device of claim 12, the method further comprising:

determining ranking of each group of address electrodes according to a load factor of each group;

combining groups of address electrodes with one another so that a sum of a load factor of a group having a high load factor and a load factor of a group having a low load factor is less than a predetermined value; and transmitting digital data of the combined groups at a predetermined time difference.

14. The program storage device of claim 13, wherein the time difference varies according to a sum of load factors of the combined groups.

15. The program storage device of claim 12, wherein digital data is transmitted at the same time upon a sum of load factors of each group being less than a predetermined value.

* * * * *